US005113526A

United States Patent [19]

Wang et al.

[11] Patent Number: 5,113,526

[45] Date of Patent: May 19, 1992

[54] PROTECTIVE CLOTHING INCORPORATING COIL SPRINGS

[76] Inventors: Enoch Y. S. Wang; Solomon H. Wang, both of Unit #1, 3111 Beckman Place, Richmond, British Columbia, Canada, V6X 3R2

[21] Appl. No.: 657,121

[22] Filed: Feb. 19, 1991

Related U.S. Application Data

[63] Continuation-in-part of Ser. No. 573,371, Aug. 27, 1990, abandoned.

[51] Int. Cl.[5] ..... A41D 13/00

[52] U.S. Cl. ..... 2/2; 2/161 R; 2/159; 2/171; 2/185 R; 2/205; 2/227; 2/79; 2/410; 2/10; 2/16; 2/51; 2/48; 36/83; 36/45; 36/58; 36/57

[58] Field of Search ..... 2/2, 2.5, 410, 411, 2/415, 10, 16, 24, 22, 51, 48, 79, 159, 160, 161 R, 171, 185 R, 205, 227; 36/83, 45, 58, 57

[56] References Cited

U.S. PATENT DOCUMENTS

| | | | |
|---|---|---|---|
| 885,767 | 4/1908 | Layton | 2/161 R |
| 1,279,230 | 9/1918 | Bilan | 2/2 |
| 1,296,113 | 3/1919 | Perlman | 2/2 |
| 1,499,805 | 7/1924 | Chatterton | 2/2 |
| 1,574,188 | 2/1926 | Friedman | 2/2 |
| 1,598,041 | 8/1926 | Bloom et al. | 2/51 |
| 1,858,162 | 5/1932 | MacNamee . | |
| 2,025,357 | 8/1934 | Pagan | 2/161 |
| 2,524,979 | 7/1949 | Kimbrell | 2/161 |
| 2,629,102 | 2/1953 | Howells | 2/51 |
| 2,710,971 | 6/1955 | Hall | 2/161 R |
| 2,737,663 | 3/1956 | Harris | 2/161 |
| 2,772,489 | 12/1956 | Porter | 36/72 |
| 2,862,208 | 12/1958 | Castro | 2/161 |
| 2,864,091 | 12/1958 | Schneider | 2/161 |
| 3,035,272 | 5/1962 | Bailey et al. | 2/161 |
| 3,091,871 | 6/1963 | Tronche | 36/72 |
| 4,039,711 | 8/1977 | Newman | 428/286 |
| 4,213,202 | 7/1980 | Larry | 2/2 |
| 4,247,097 | 1/1981 | Schwartz | 272/67 |
| 4,303,239 | 12/1981 | Walsh, Jr. | 272/119 |
| 4,330,120 | 5/1982 | Netti | 272/119 |
| 4,351,065 | 9/1982 | Bouchard | 2/23 |
| 4,526,828 | 7/1985 | Fogt et al. | 428/229 |
| 4,745,636 | 5/1988 | Lunt | 2/402 |
| 4,766,612 | 8/1988 | Patton, Sr. | 2/161 R |
| 4,841,577 | 6/1989 | Lars-Jos | 2/161 R |

FOREIGN PATENT DOCUMENTS

| | | | |
|---|---|---|---|
| 3027 | 12/1901 | France | 2/22 |
| 988994 | 9/1951 | France | 2/24 |
| 1133342 | 3/1957 | France | 2/161 |
| 2525083 | 10/1983 | France . | |
| 849700 | 9/1960 | United Kingdom | 2/22 |
| 955486 | 4/1964 | United Kingdom | 2/22 |

*Primary Examiner*—Werner H. Schroeder
*Assistant Examiner*—Gloria Hale
*Attorney, Agent, or Firm*—Barrigar & Oyen

[57] ABSTRACT

Previous types of armored safety workwear are too inflexible, heavy or expensive to be useful. The present invention provides an article of protective clothing comprising a flexible supporting material and a plurality of elongated coil springs held in close proximity to the surface of said supporting material at spaced locations. Preferably, the coil springs are free to rotate in relation to the supporting material. The coil springs are held in elongated pockets secured to the surface of said supporting material.

27 Claims, 10 Drawing Sheets

PROTECTIVE CLOTHING INCORPORATING COIL SPRINGS

CROSS-REFERENCE TO RELATED APPLICATIONS

This application is a continuation-in-part of application Ser. No. 07/573,371 filed Aug. 27, 1990, now abandoned.

FIELD OF THE INVENTION

This invention relates to protective work clothing for use in protecting the wearer from accidents involving power tools. More particularly the invention relates to protective clothing for reducing injury to a worker from accidents involving power tools such as power saws, grinders and sanders.

BACKGROUND OF THE INVENTION

Injuries to operators of power tools such as power saws, grinders and sanders are common. Such injuries occur either directly through contacting a part of the operator's body with the cutting blade or abrasive surface, or by the operator's clothing becoming entangled in the power machinery.

Armoured safety workwear employing metal chain, mesh or metal plates has been available in the prior art for protection of power tool operators, but such workwear has a number of disadvantages.

For example U.S. Pat. No. 4,766,612 discloses a protective work glove that uses stiff, metal bars which are removably insertable into cavities along the back of each finger of the glove. However, as the glove is principally designed to protect the hand from mashing or crushing type injuries, it is not sufficiently flexible to be useful as a work glove for operating power tools. U.S. Pat. No. 2,862,208 discloses another protective glove intended for use by industrial and agricultural workers to protect against cutting by a tool blade. Metal chains are inserted into passages extending along the back of the index and middle finger and around the thumb of the glove. While such chains are more flexible than metal bands, such chains are heavy, particularly, if used in a number of pieces of the wearer's clothing, and this glove does not allow for easy installation and replacement of the metal chains.

A third safety glove for protection against cutting blades is disclosed in U.S. Pat. No. 2,737,663. It comprises a skeleton frame-work of protective straps, certain of which are stretchable to permit flexing of the wearer's hand. The flexible straps are formed of a series of interconnected tubes, presumably metal, joined in the interior of the tubes by coil springs. The coil springs provide a resilient rather than protective function. Such a glove is clearly difficult and expensive to manufacture. U.S. Pat. No. 1,574,188 discloses a bulletproof vest. Strips of aluminum alloy are held in overlapping relationship in pockets sewn in the vest. Again this construction is too heavy and inflexible to be useful for protective gloves and the like for power tool operators.

The various prior art articles of protective clothing suffer from a number of problems, whether excessive weight, lack of flexibility, or expense of manufacture. The prior art articles which employ chains and circular straps as armour in gloves were principally designed to protect the wearer's hand from knife edges which cut by slicing with a sharp straight edge. Such articles offer inadequate protection against the hardened, high-speed teeth of modern power tools. Further, in many cases the design of the protective clothing is such that it may become entangled in the rotating machinery causing injury to the operator.

It is therefore an object of this invention to provide improved lightweight and flexible protective clothing to reduce injury to the wearer from power tool accidents. It is another object of this invention to provide novel protective clothing which uses common cylindrical coil springs as its armour to help protect the wearer. Still other objects can be found in the more detailed description which follows.

SUMMARY OF THE INVENTION

The present invention provides an article of protective clothing comprising a flexible supporting material and a plurality of elongated coil springs held in close proximity to the surface of said supporting material at spaced locations. The coil springs are free to rotate in relation to said supporting material and are held in elongated pockets secured to the surface of said supporting material.

According to a further aspect of the invention, the coil springs comprise an inner coil spring and an outer coil spring, the inner coil spring having an outer diameter less than the inner diameter of the outer coil spring.

BRIEF DESCRIPTION OF THE DRAWINGS

The novel features which are believed to be characteristic of this invention are set forth with particularity in the appended claims. The invention itself, however, both as to its organization and method of operation, together with further objects and advantages thereof, may best be understood by reference to the following description taken in connection with the accompanying drawings in which:

FIGS. 10*a* and 10*c* are side elevations illustrating a protective boot incorporating the invention;

FIG. 10*b* and 10*d* are cross-section taken along lines X—X of FIG. 10*a*;

DETAILED DESCRIPTION OF A PREFERRED EMBODIMENT

According to the invention, coil springs are positioned at appropriate locations on the surface of the apparel. The diameter of such coil springs is preferably about one-quarter inch and the material is preferably stainless steel, but other diameters and materials will also function usefully. The coil springs do not function to completely prevent the cutting blade from cutting through the surface of the clothing. Rather the coil springs provide an initial resistance to the passage of the cutting blade accompanied by a margin of safety which allows the operator to react and withdraw the appendage before the cutting blade penetrates through the protective clothing. The invention is of course most useful for use with blades which are not specifically designed for cutting metal.

Preferably the coil springs are secured in position by means of elongated pockets in each of which a single spring sits loosely and free to rotate. This construction adds certain advantages. By permitting the coil spring to rotate, the cutting blade will generally take longer to penetrate and grab or slice through the spring. Rather the moving blade or abrasive surface will cause the spring to rotate rather than cutting through it, thus providing a further safety delay during which the operator may react. This feature also reduces the likelihood of the article of apparel being caught in the blade and entangling in the machinery.

To further reduce the likelihood of the clothing becoming caught or entangled by the machinery, it is preferred that the pockets be formed of a textile manufactured from short fibres. The pockets are readily formed by stitching a layer of such textile to the surface of the cloth, leather, rubber or other material which forms the article of apparel by means of parallel stitches spacedapart so as to accommodate a single coil spring. Although the descriptions below refer to sewing, the pockets may also be attached to the apparel by a suitable adhesive means. One end of each pocket is closed and into each pocket is inserted a single steel coil spring. Each pocket has means to open and close the open end of the pocket to secure or remove the spring, such as a hinged flap and snap fastener or similar means such as VELCRO to removably secure the flap over the open end to thereby secure the steel spring coil in the pocket.

Figure 1B:
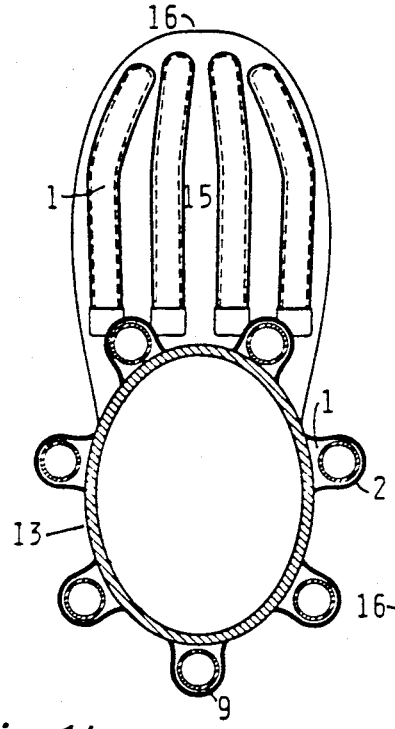
FIG. 1*b* is a top plan view of the protective boot of FIG. 1*a*, including a cross-sectional view taken at I—I of FIG. 1*a*.
Figure 1A:
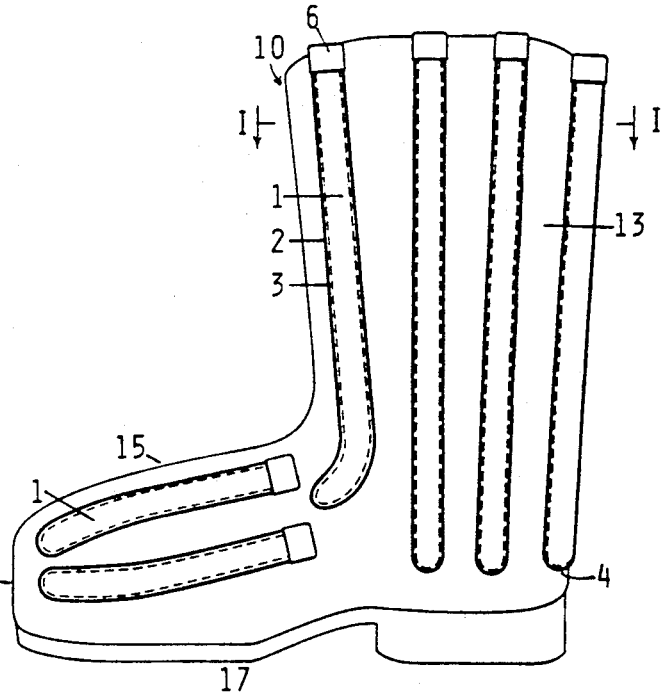
FIG. 1*a* is a side elevation view of a protective boot incorporating the invention.
Figure 1D:
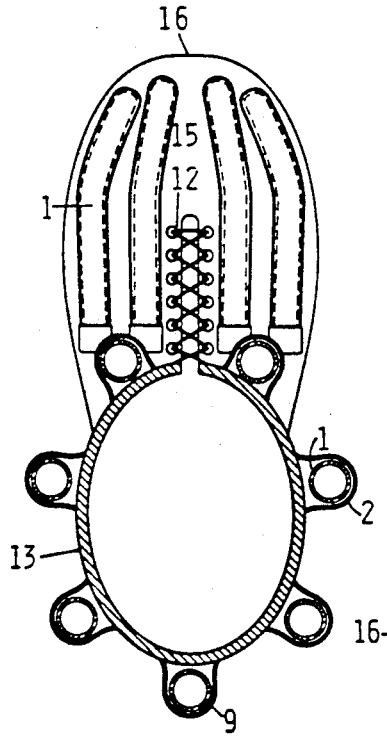
FIG. 1*d* is a top plan view of the protective boot of FIG. 1*c*, including a cross-sectional view taken at II—II of FIG. 1*c*.
Figure 1C:
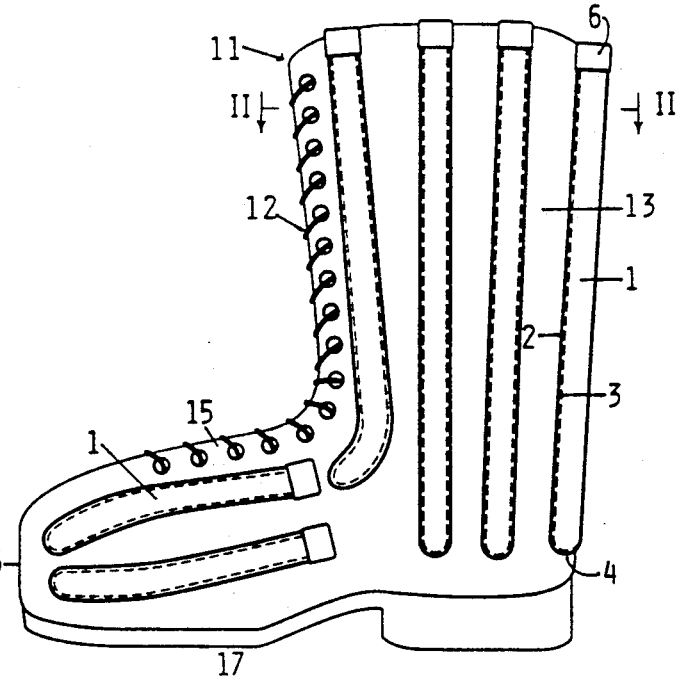
FIG. 1*c* is a side-elevation view of the protective boot closed with a boot lace.

In FIGS. 1*a* and 1*b* there is shown an embodiment of the invention in the form of a protective boot 10. FIGS. 1*c* and 1*d* show an alternative embodiment except that the boot 11 includes laces 12. The protective boots are made of standard materials such as cloth, leather or rubber. A plurality of spring pockets 1 are formed on the leg 13 of the protective boot by sewing a layer of material 2 to the boot with two parallel lines of stitches 3 spaced-apart as to freely accommodate the diameter of the steel coil springs and providing a closed end 4. Each spring pocket will hold one steel coil spring. A number of spring pockets 1 into which coil springs are inserted, are also formed on the vamp 15 of the protective boot . The length of the spring coils 9 and spring pockets 1 varies with the height of the boot-leg 13. A flap 6 extends across the open end 5 of each spring pocket 1, for use in securely closing the pockets thereby keeping the steel coil-springs in the spring pockets. It may be secured in the closed position by a snap, VELCRO or the like. The toes 16 and sole 17 of the boot could be protected by steel plate in existing fashion.

Figure 2:
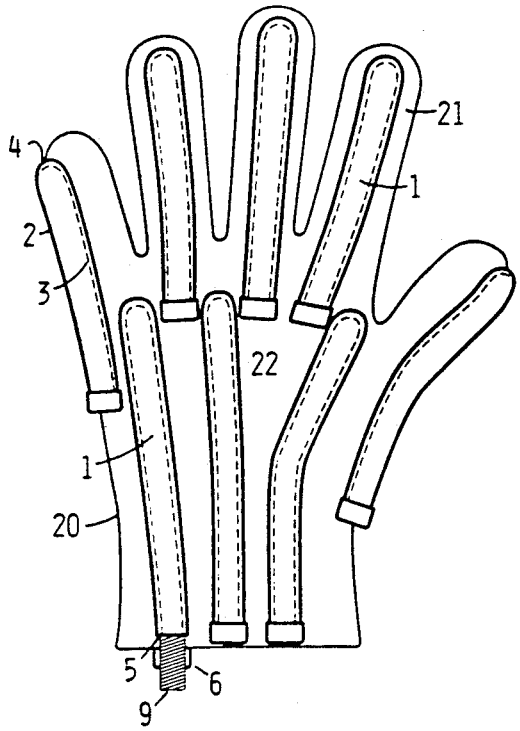
FIG. 2 is a plan view of a protective glove incorporating the invention.

A further embodiment of the invention is in the form of a protective glove 20 shown in FIG. 2. The protective glove is made of cloth, leather, rubber or like material and can be developed for right or left-handed power tool operators. Spring pockets 1 are formed by sewing a second layer of flexible glove material 2 to the surface of the glove by means of parallel lines of stitches 3 spaced apart so as to easily accommodate the diameter of the steel coil springs and providing a closed end 4. Each spring pocket will hold one steel coil spring 9. A flap 6 extends across an open end 5 of each spring pocket 1 and may be provided with closure means such as a snap, VELCRO or the like for use in securely closing the pockets thereby keeping the steel coil springs in the spring pockets. Spring pockets extend along the lengths of each finger 21 and at spaced locations on the back of the hand 22. An alternative embodiment is to form the material into a protective mitt which, in turn, would be provided with the necessary spring pockets. A further method of manufacturing is to form the spring pockets on a first glove-shaped piece of material and subsequently sew this upper piece to a lower glove-shaped piece, thereby forming a complete glove.

Figure 3:
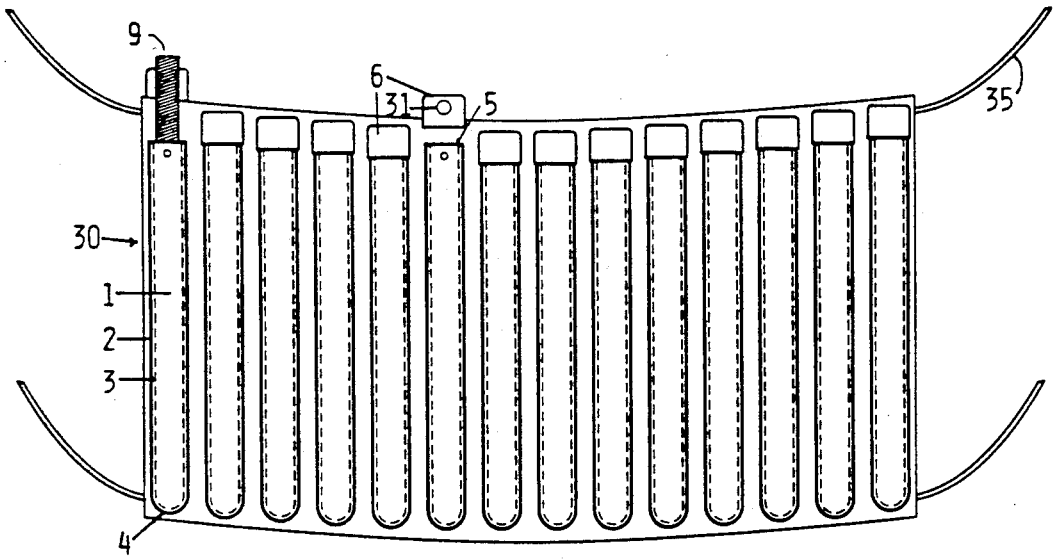
FIG. 3 is a front elevational view of a protective apron incorporating the invention.

In FIG. 3, there is shown another embodiment of the invention in the form of a protective apron 30 for fastening around the chest or stomach area. A number of spring pockets 1 are formed by sewing a layer of suitable material to the surface of a standard apron constructed of fabric, leather, rubber or like material using parallel rows of stitching 3 to form elongated pockets with a closed end 4. Each spring pocket 1 will hold one steel coil spring 9. Coil spring 9 is shown partially retracted from the pockets 1. The length of each coil spring will be typically about 15 inches. A flap 6 extends across the open end 5 of the spring pockets to releasably retain the steel coil springs in the spring pockets using a snap 31 or other fastener to secure the flap. The protective apron can be wrapped around the legs, arms, chest or abdomen and fastened with tie-straps 35 which extend from the end of the apron.

Figure 4A:
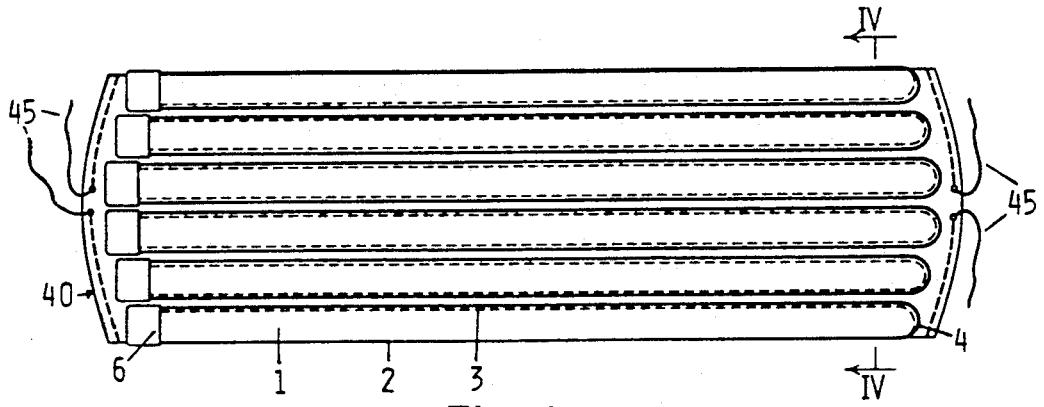
FIG. 4*a* is a front elevational view of a protective sleeve or legging incorporating the invention.
Figure 4B:
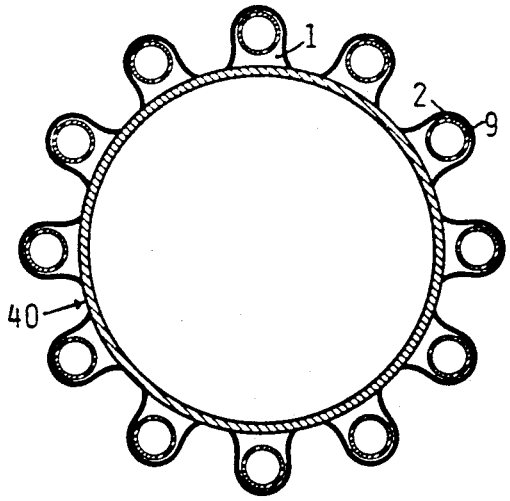
FIG. 4*b* is a cross-sectional view taken at IV—IV of FIG. 4*a* with all the steel coil springs inserted in the spring pockets.
Figure 4C:
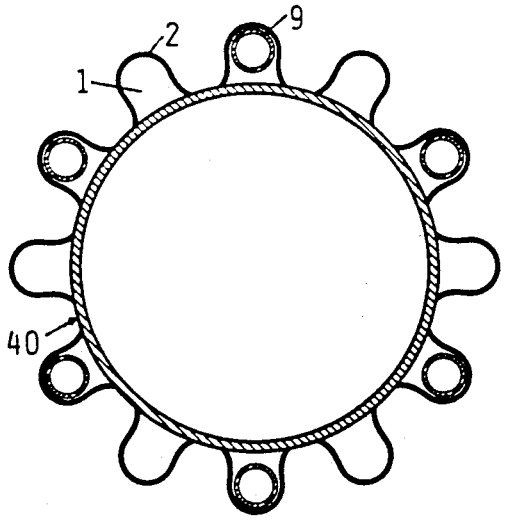
FIG. 4*c* is a cross-sectional view taken at IV—IV of FIG. 4*a*, with steel coil springs inserted in alternate spring pockets.

In FIGS. 4*a*, 4*b* and 4*c*, there is shown a further embodiment of the invention in the form of a protective sleeve 40 which may be used to protect the wearer's arm or leg. The protective sleeve is cylindrical in shape made of cloth, leather, rubber or similar material with a drawstring 45 to tighten it in position. A plurality of spring pockets 1 are formed by sewing a layer of material 2 to the surface of the sleeve or legging using parallel rows of stitching 3 to form elongated pockets with a closed end 4. Each spring pocket 1 will hold one steel coil spring 9. The length of the coil spring in spring pocket will vary with the size of arm or leg to be protected. Flaps 6 extend across the open end of the spring pockets to removably secure the steel coil springs in the spring pockets by way of a snap fastener, VELCRO or the like.

Figure 5:
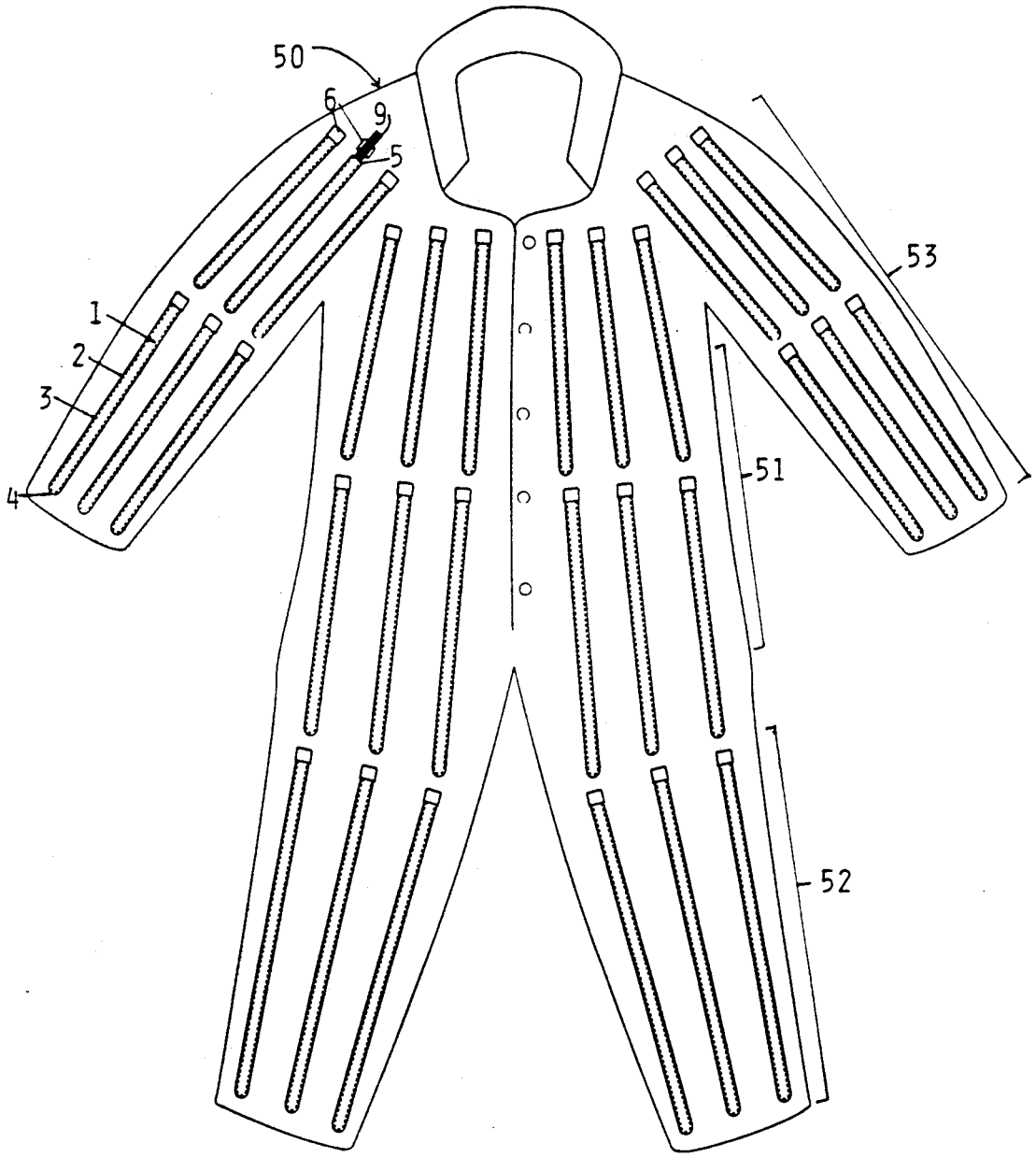
FIG. 5 is a front-elevational view of a protective suit incorporating the invention.

In FIG. 5, there is shown another embodiment of the invention in the form of a protective suit 50. The protective suit is made of cloth or other like material. Rather than a complete suit, a work shirt, vest or pants could be formed in similar fashion. A plurality of spring pockets 1, are formed by sewing a layer of material 2 to the suit forming parallel rows of stitches 3 in the appropriate locations, forming pockets closed at one end 4. A series of spring pockets extend along the lengths of the body 51 and legs 52 while other pockets extend along the arms 53. The spring pockets cover the entire body. Each spring pocket 1 will hold one steel coil spring. The wearer may decide which areas of the body are to be protected and insert coil springs into the applicable pockets. A flap 6 extends across the open end of the spring pockets for removably securing the steel coil springs in the spring pockets using a snap fastener, VELCRO or the like.

Figure 6:
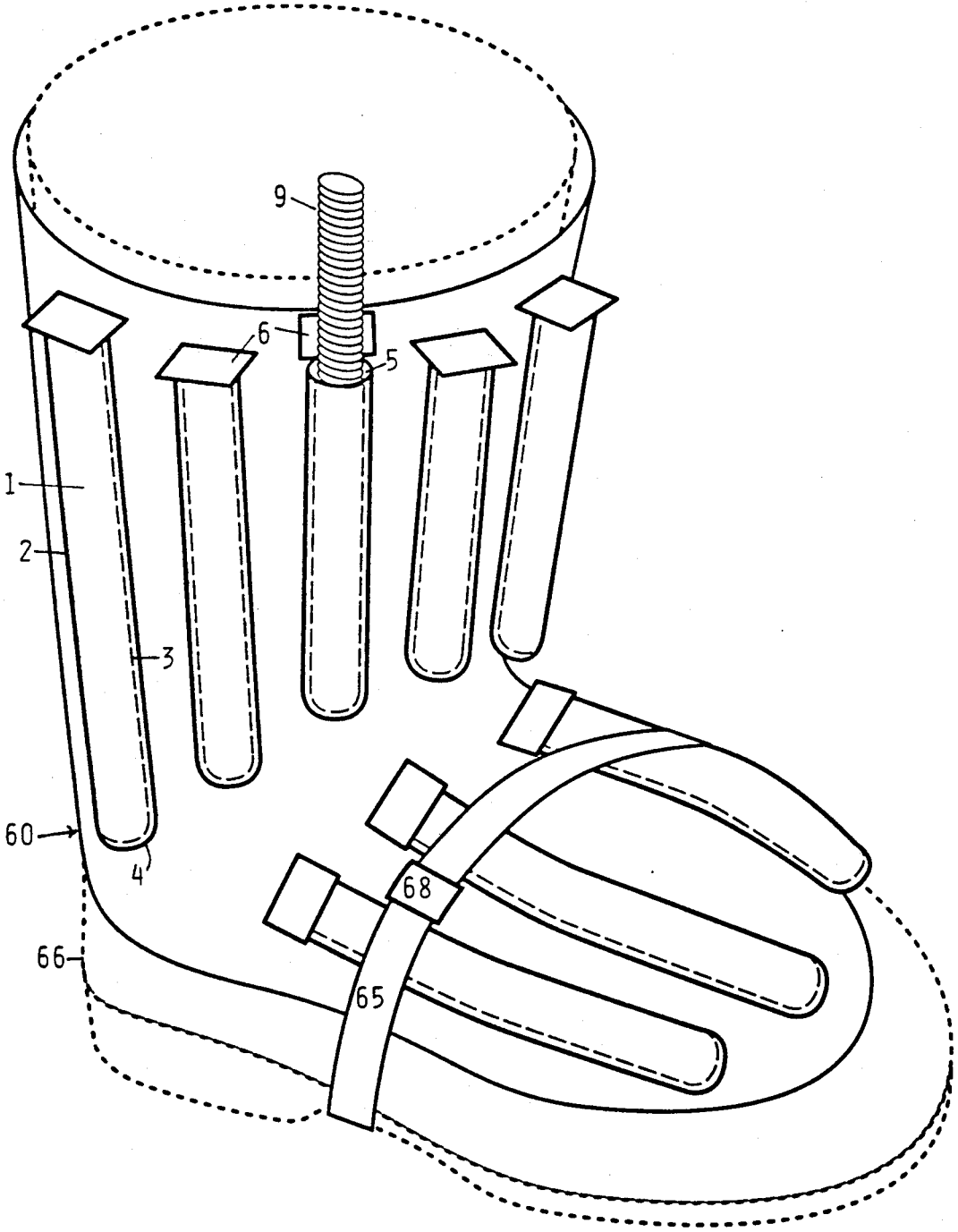
FIG. 6 is a perspective view of a spat incorporating the invention.

In FIG. 6, there is shown another embodiment of the invention in the form of protective spats 60 for fastening to a standard pair of boots or shoes 66. A number of spring pockets 1 are formed by sewing a layer of suitable material 2 to the surface of a standard spat constructed of fabric, leather, rubber or like material using parallel rows of stitching 3 to form elongated pockets with a closed end 4. Each spring pocket 1 will hold one steel coil spring 9. The length of each coil spring will be typically about 15 inches. A flap 6 extends across the open end 5 the spring pockets to releasably retain the steel coil springs in the spring pockets using a snap or other fastener to secure the flap. The protective spat is secured to the boot with tie-strap 65 and buckle 68.

Figure 7A:
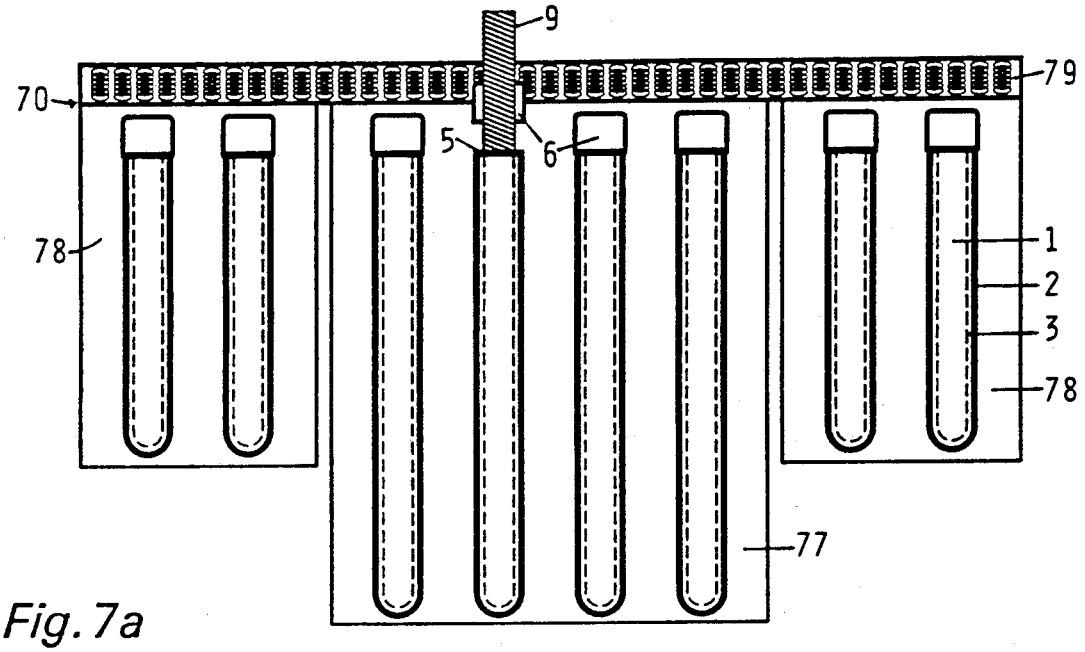
FIG. 7*a* is a plan view of a neckprotector incorporating the invention.
Figure 7B:
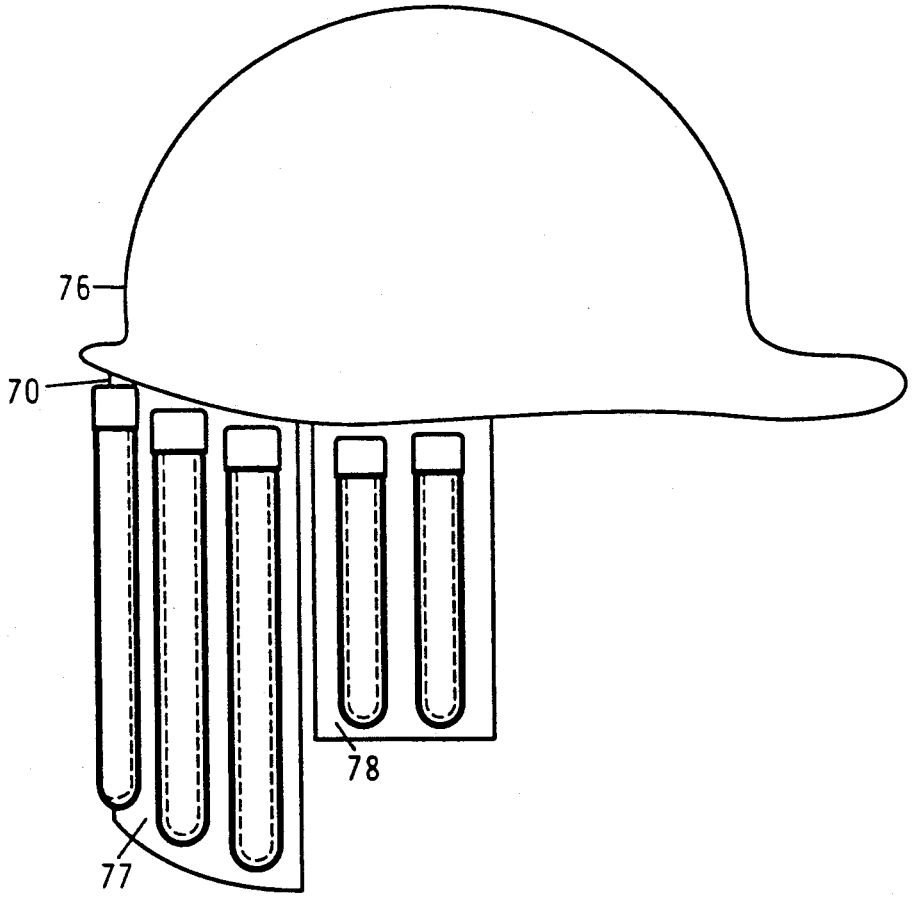
FIG. 7*b* is a side view of the neck protector of FIG. 7*a* attached to a hard hat.

In FIG. 7*a*, there is shown another embodiment of the invention in the form of a neck protector 70 for attaching to a hard hat 76. A number of spring pockets 1 are formed by sewing a layer of suitable material 2 to the surface of a neck protector consisting of nape flap 77 and side flaps 78 constructed of fabric, leather, rubber or like material using parallel rows of stitching 3 to form elongated pockets with a closed end 4. Each spring pocket 1 will hold one steel coil spring 9. A flap 6 extends across the open end 5 of the spring pockets to releasably retain the steel coil springs in the spring pockets using a snap or other fastener to secure the flap. The neck protector 70 is attached to the hard hat using VELCRO or other fastening means 79.

FIGS. 8*a* through 15 illustrate a second embodiment of the invention in which dual nested closed coil springs are utilized. One of the advantages of the invention lies in the fact that the springs are free-rolling within a spring pocket and consequently it is difficult for a rotating cutting blade to cut through the spring since the rotational force of the cutting blade is diverted to spin rotate the spring rather than cutting through it. Closed coil springs (as opposed to open coil compression springs) have been found to be advantageous because the cutting blade will contact more than one coil of the spring at a given time, making it more difficult for the cutting blade to cut through the coil or become caught between coils. Such springs maintain the advantages of free-rolling and flexibility.

In this second embodiment, the spring consists of a smaller diameter cylindrical closed-coil inner spring nested co-axially in a larger diameter closed coil outer spring. The length of the inner spring is less than or equal to that of the outer spring. The inner spring is free to rotate relative to the outer spring, just as the outer spring is free to rotate in the spring pocket.

Figure 9A:
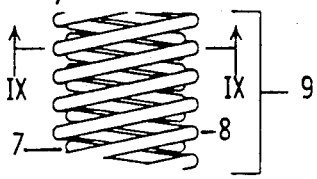
FIG. 9*a* is a partial elevational view of one of the protective spring units illustrated in FIG. 8, with the coils of the outer spring stretched to illustrate the opposite helical wrap direction of the inner coil spring.

Preferably the springs are nested, as shown in FIG. 9*a*, so that the direction of the slope of the coils of the inner spring, in relation to the longitudinal axis of the spring, is opposite to that of the outer spring. For example, in FIG. 9*a* the slope of the inner spring 7 is opposite in relation to the longitudinal axis of the spring from that of outer spring 8. The double layering and opposite winding increase the resistance of the spring to cutting or catching by a cutting blade or teeth.

A further feature of the invention is that the cloth material used to form the spring pockets is preferably thinner than the material used for the supporting article of clothing. The pockets are attached to the supporting material simply by stitching. By using a lighter or thinner material for the pocket, when the pocket is contacted by a cutting blade or teeth, it tears more easily with less likelihood of becoming caught in the blade with resultant injury to the worker. The thread used to stitch the spring pockets can also be selected as a lighter thread than that used for the rest of the article to achieve the same result. Also by forming each spring pocket individually from a separate piece of material, the tendency will be for the pocket to tear away from the garment without becoming entangled.

With reference specifically to FIGS. 8 through 15, individual spring pockets 1 are formed on a flexible supporting material, which may be cloth, leather, rubber or like material. The pockets 1 are formed by sewing a layer of spring pocket material 2 to the flexible supporting material with lines of stitching 3, in a manner which forms a closed end 4 and an open end 5. Pockets 1 are formed to freely accommodate the diameter of the protective spring 9, which consists of a smaller diameter closed-coil inner spring 7 nested inside a larger diameter closed-coil outer spring 8. The open end of pocket 1 is closed by a pocket flap 6, with one pocket in FIGS. 8*a* and 8*b* shown in an open position with springs 7 and 8 partially withdrawn to show the ease of replacing the springs.

Figure 8A:
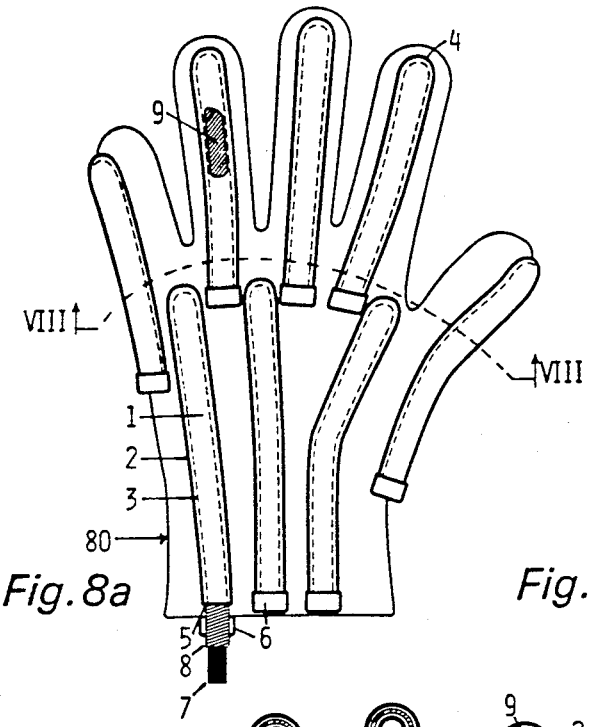
FIG. 8*a* is an elevation illustrating a protective glove incorporating the invention, including a partial cutaway view of a spring pocket showing one of the protective springs.
Figure 8B:
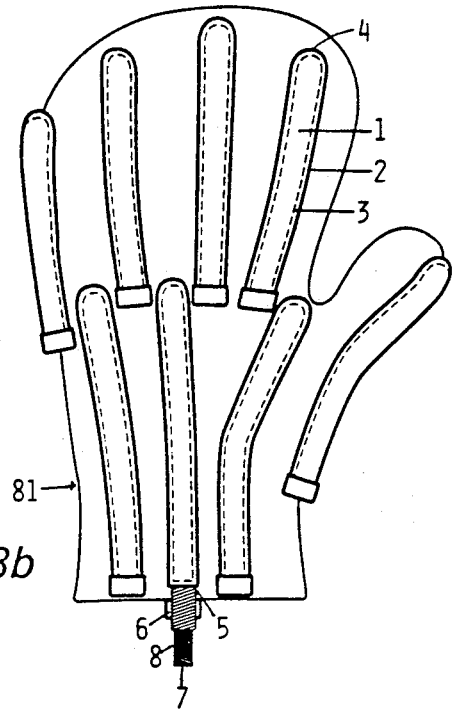
FIG. 8*b* is an elevation illustrating a protective mitt incorporating the invention.
Figure 8C:
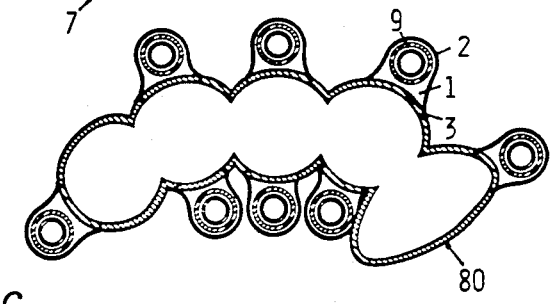
FIGS. 8*c*, 8*d* and 8*e* are transverse sectional views taken along lines VIII—VIII of FIG. 8*a*, illustrating embodiments of the invention with spring pockets formed on the front and back of the glove, the back only, and the front only, respectively.
Figure 8D:
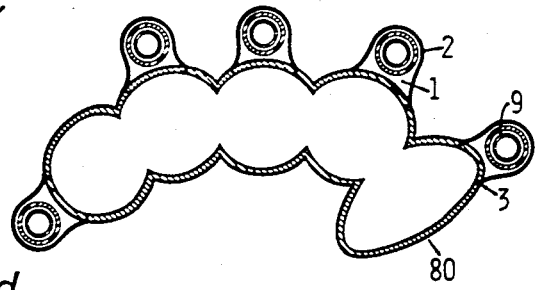
Figure 9B:
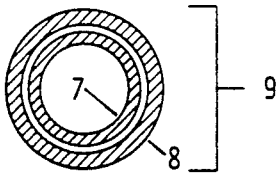
FIG. 9*b* is a sectional view taken along lines IX—IX of FIG. 9*a*.
Figure 8E:
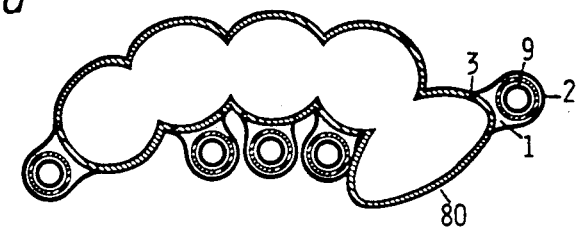

FIGS. 8*a* and 8*b* illustrate two embodiments of the invention, the flexible supporting material being in the form of a glove 80 and a mitt 81 respectively, and which can be designed for right- or left-handed power tool operators. The spring pockets 1 can be formed on the sides, front and back of glove 80 as shown in FIG. 8*c*, on the sides and back only as shown in FIG. 8*d*, or on the sides and front only as in FIG. 8*e*. The placement of spring pockets and closed-coil springs shown in FIGS. 8*c*, 8*d* and 8*e* is also applicable to the mitt 81, and will be variable depending upon which areas of the hand require protection for a given power tool.

Figure 10A:
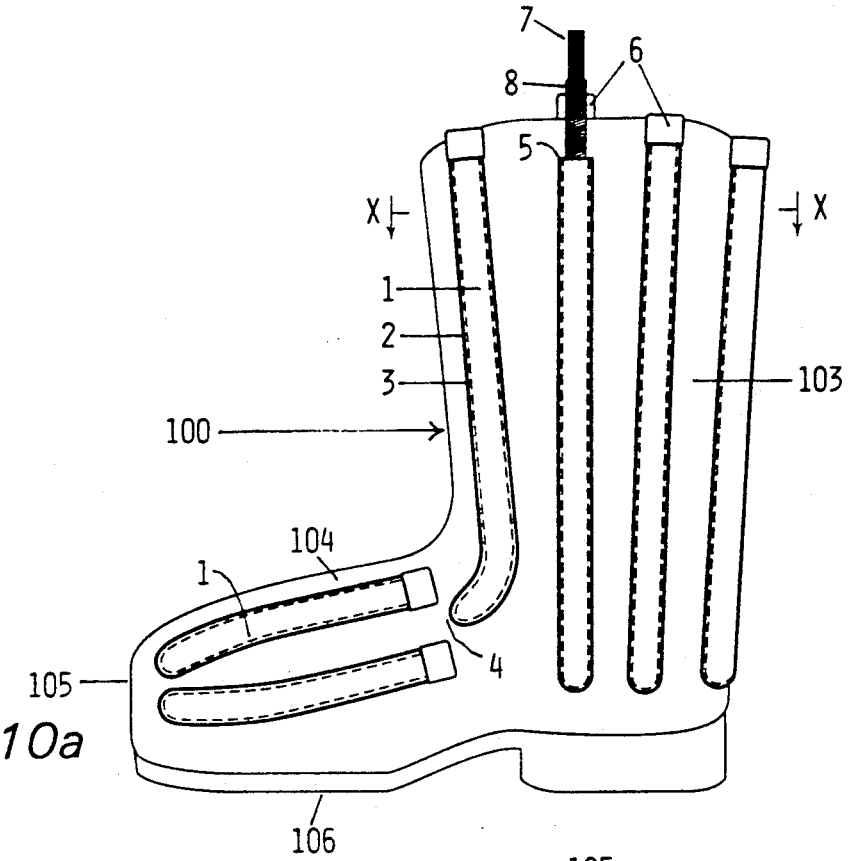
Figure 10B:
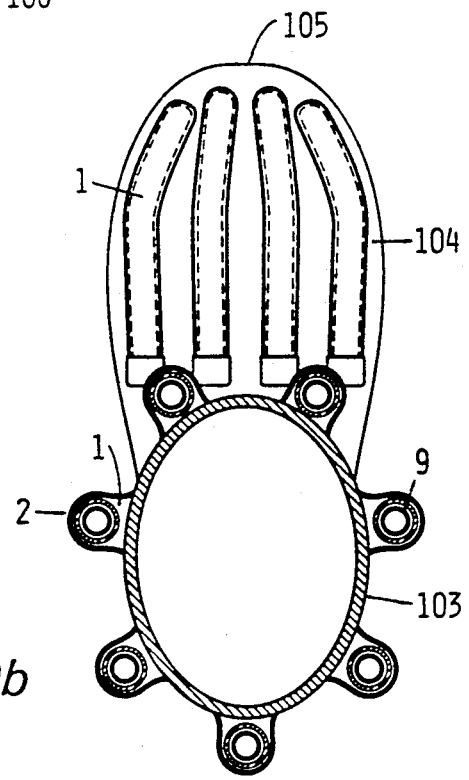
Figure 11:
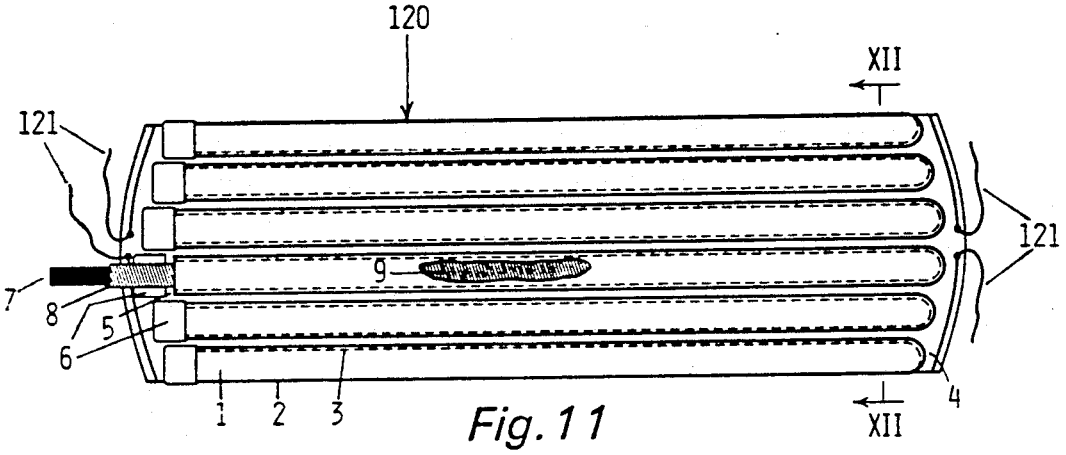
FIG. 11 is a plan view illustrating a protective sleeve incorporating the invention.
Figure 12A:
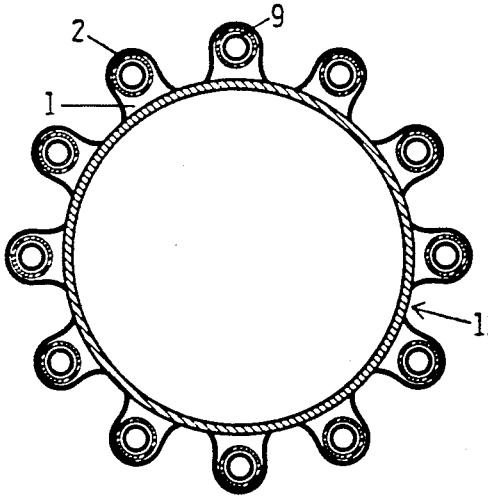
FIGS. 12*a* and 12*b* are sectional views taken along lines XII—XII of FIG. 11 showing coil springs installed in all or alternating spring pockets respectively.
Figure 12B:
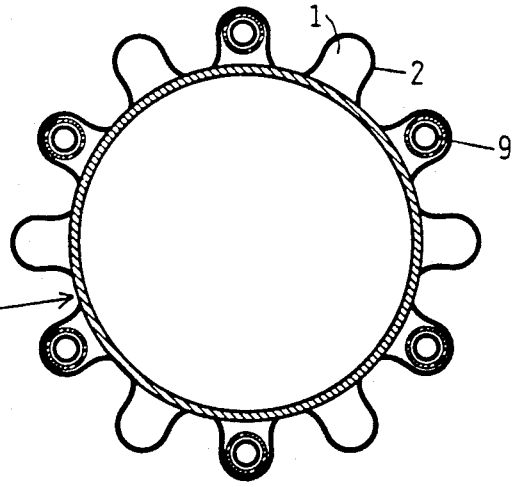

FIGS. 10*a* and 10*b* illustrate another embodiment of the invention in which the flexible supporting material is in the form of a protective boot 100. Spring pockets 1 are formed around the leg 103 of the boot and on the vamp 104 of the boot. The length of the springs 9 will vary with the height of the boot leg. The toe 105 and sole 106 of the protective boot could be further protected by a steel plate in existing fashion.

FIGS. 11, 12*a*, 12*b* and 12*c* illustrate another embodiment of the invention in which the flexible supporting material is in the form of a cylindrical protective sleeve 120 for protecting the wearer's arm or leg. The protective sleeve is secured to a limb by means of a drawstring 121. A plurality of parallel spring pockets 1 are formed on the protective sleeve exterior. The length of the protective sleeve, spring pockets and coil springs will vary depending on the length of the limb to be protected.

Figure 13:
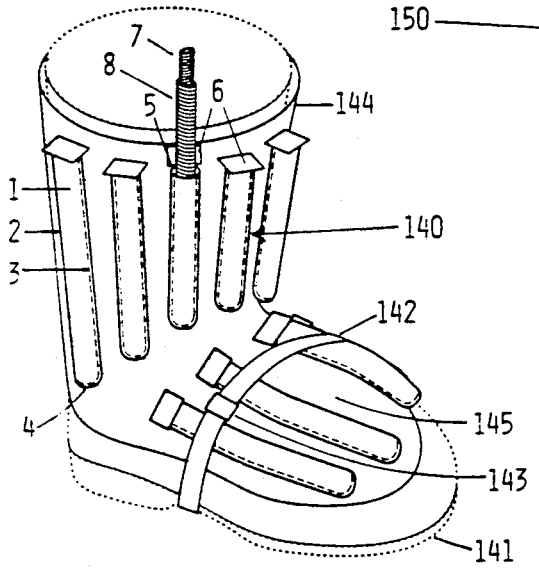
FIG. 13 is a perspective view illustrating a protective spat incorporating the invention and fitted over a conventional boot.

FIG. 13 illustrates a further embodiment of the invention, the flexible supporting material being in the form of a protective spat 140, shown secured over a conventional boot 141 with strap 142 and buckle 143. A plurality of spring pockets 1 are formed vertically around leg 144 and horizontally along the length of the vamp 145 of the protective spat.

Figure 14:
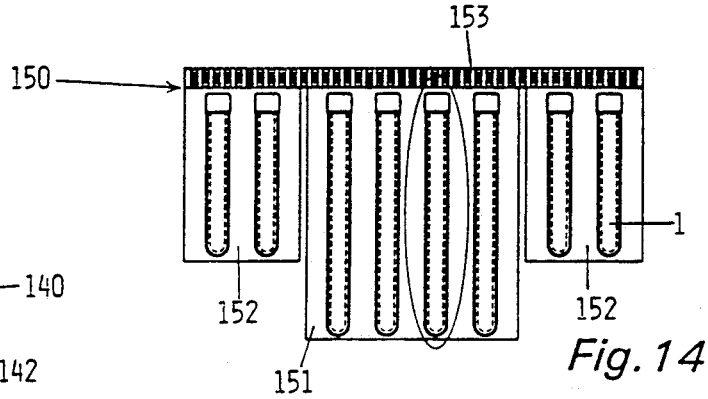
FIG. 14 is a front elevation of a protective neck protector incorporating the invention.
Figure 15:
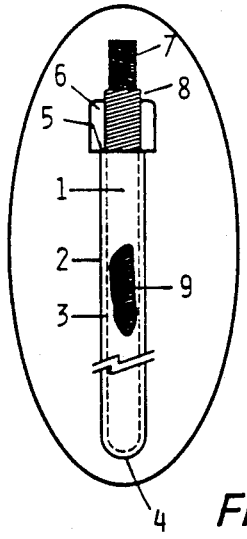
FIG. 15 is an enlarged detail view of a coil spring and spring pocket of FIG. 14 with the coil spring partially withdrawn and the spring pocket partially cut away for illustration.

FIGS. 14 illustrates a further embodiment of the invention, the flexible supporting material being in the form of a neck protector 150, consisting of a plurality of vertical parallel spring pockets 1 formed on the nape flap 151 and two side flaps 152. A VELCRO strip 153 attaches the neck protector 150 to the rim of a hard hat.

While the invention has been described with respect to certain specific embodiments, it will be appreciated that many modifications and changes may be made by those skilled in the art without departing from the spirit of the invention. It is intended, therefore, by the appended claims to cover all such modifications and changes as fall within the true spirit and scope of the invention. For example, while the pockets for containing the coil springs have been described as being secured to the supporting material along parallel lines, the same benefits could be obtained with pockets having sides which taper slightly from a wider neck to a narrower closed end.

What is claimed is:

1. An article of protective clothing comprising a flexible supporting material and a plurality of elongated coil springs held in close proximity to the surface of said supporting material in elongated pockets formed adjacent to the surface of said supporting material at spaced locations wherein said coil springs are free to rotate within said pockets in relation to said supporting material.

2. The article of protective clothing of claim 1 wherein said pockets each comprise a layer of flexible material secured to said supporting material.

3. The article of protective clothing of claim 1 wherein said supporting material forms a glove.

4. The article of protective clothing of claim 1 wherein said supporting material forms a mitt.

5. The article of protective clothing of claim 1 wherein said supporting material forms an apron.

6. The article of protective clothing of claim 1 wherein said supporting material forms a sleeve.

7. The article of protective clothing of claim 1 wherein said supporting material forms a suit.

8. The article of protective clothing of claim 1 wherein said supporting material forms a boot.

9. The article of protective clothing of claim 1 wherein said supporting material forms a spat.

10. The article of protective clothing of claim 1 wherein said supporting material hangs downwardly from a hat to substantially cover the side and back of the wearer's neck.

11. The article of protective clothing of claim 1 wherein each said elongated pocket has an open end and means to releasably close said open end.

12. The article of protective clothing of claim 1 wherein said coil springs comprise an inner coil spring and an outer coil spring, said inner coil spring having an outer diameter less than the inner diameter of said outer coil spring.

13. The article of protective clothing of claim 12 wherein said inner coil spring is free to rotate relative to said outer coil spring.

14. The article of protective clothing of claim 12 wherein said inner and outer coil springs are closed-coil springs.

15. The article of protective clothing of claim 13 wherein said inner coil spring is freely separable from said outer coil spring.

16. The article of protective clothing of claim 12 wherein the direction of slope of the coils of said inner coil spring is opposite to the direction of slope of the coils of said outer coil spring.

17. The article of protective clothing of claim 12 wherein the length of said inner coil spring is less than or approximately equal to the length of said outer coil spring.

18. The article of protective clothing of claim 2 in which said flexible pocket material is more readily cut or torn than said supporting material.

19. The article of protective clothing of claim 2 wherein each said pocket is formed of a separate piece of flexible material.

20. The article of protective clothing of claim 2 wherein said pockets are secured to said supporting material by stitching.

21. The article of protective clothing of claim 20 wherein said stitching is readily broken when contacted by the operative cutting edge of a power tool.

22. The article of protective clothing of claim 11 wherein said means for releasably closing said open end comprises a flap having one end secured to said article and one end releasably secured to said article, and means for releasably securing said releasable end.

23. The article of protective clothing of claim 22 wherein said means for releasably securing said releasable end of said flap comprises a hook and loop fastener.

24. The article of protective clothing of claim 1 wherein said coil springs are each freely removable from said pockets.

25. The article of protective clothing of claim 12 wherein said coil springs are each freely removable from said pockets.

26. The article of protective clothing of claim 1 wherein said coil springs are each free of any connection to said pockets.

27. The article of protective clothing of claim 13 wherein said coil springs are each free of any connection to said pockets.

* * * * *